US007866954B2

(12) United States Patent
Kim et al.

(10) Patent No.: US 7,866,954 B2
(45) Date of Patent: Jan. 11, 2011

(54) VALVE AND MICRO FLUID PUMP HAVING THE SAME

(75) Inventors: Duck-jong Kim, Daejeon (KR); Yun-wook Hwang, Daejeon (KR); Yu-chang Kim, Daejeon (KR); Sang-jin Park, Daejeon (KR); Pil-woo Heo, Daejeon (KR); Eui-soo Yoon, Daejeon (KR); Deuk-yong Koh, Daejeon (KR)

(73) Assignee: Korea Institute of Machinery & Materials (KR)

( * ) Notice: Subject to any disclaimer, the term of this patent is extended or adjusted under 35 U.S.C. 154(b) by 1047 days.

(21) Appl. No.: 11/617,865

(22) Filed: Dec. 29, 2006

(65) Prior Publication Data

US 2008/0075605 A1 Mar. 27, 2008

(30) Foreign Application Priority Data

Sep. 22, 2006 (KR) ..... 10-2006-0092424

(51) Int. Cl.
*F04F 1/06* (2006.01)

(52) U.S. Cl. ..... 417/118; 417/120; 137/251.1

(58) Field of Classification Search ..... 137/804, 137/807, 251.1; 417/118, 143, 388, 92, 108
See application file for complete search history.

(56) References Cited

U.S. PATENT DOCUMENTS

| | | | | |
|---|---|---|---|---|
| 4,460,018 | A * | 7/1984 | Sweeney | 137/807 |
| 6,766,817 | B2 | 7/2004 | da Silva | |
| 6,918,404 | B2 | 7/2005 | Dias da Silva | |
| 7,066,586 | B2 | 6/2006 | da Silva | |
| 7,285,255 | B2 | 10/2007 | Kadlec et al. | |

* cited by examiner

*Primary Examiner*—Devon C Kramer
*Assistant Examiner*—Philip Stimpert
(74) *Attorney, Agent, or Firm*—Cantor Colburn LLP

(57) ABSTRACT

Disclosed herein are a valve and a micro fluid pump having the same. The valve is mounted in a micro fluid pump having a capillary tube, to which a gas supply unit and a fluid transfer pipe are connected, for controlling the introduction and the discharge of fluid. The valve includes a discharge pipe filled with liquid such that the discharge pipe has a predetermined resistance pressure and constructed in a structure in which one end of the discharge pipe is connected to the capillary tube such that the discharge pipe communicates with the interior of the capillary tube, and the other end of the discharge pipe is open, thereby allowing gas out of the capillary tube through the discharge pipe when a gas pressure in the capillary tube exceeds the resistance pressure of the discharge pipe.

3 Claims, 7 Drawing Sheets

Pa < Pc < Pb

Pc < Pa < Pb

Pa > Pb
Pa > Pc

Pa < Pc < Pb

Pc < Pa < Pb

Pa > Pc
Pa > Pb

VALVE AND MICRO FLUID PUMP HAVING THE SAME

BACKGROUND OF THE INVENTION

1. Field of the Invention

The present invention relates to a valve and a micro fluid pump having the same, and, more particularly, to a valve including a discharge pipe filled with liquid such that the discharge pipe has a predetermined resistance pressure and allowing gas out of the capillary tube through the discharge pipe, when a gas pressure in the capillary tube exceeds the resistance pressure of the discharge pipe, and a micro fluid pump having the same.

2. Description of the Related Art

Recently, there has been actively developed a micro electro mechanical system (MEMS), which has been widely applied to various fields, such as genetic engineering, medical diagnosis, and new medicine development.

Especially, a lab-on-a-chip (LOC) technology has been proposed to perform all processes, including general chemical reaction and analysis, using a single chip in the micro electro mechanical system.

The LOC is used to integrate and automatically analyze sample pre-process, reaction, separation, and detection devices necessary for sample analysis on a small-sized chip, such as glass, plastic, or silicon, using a micro machining method.

The sample analysis using the LOC has an advantage in that experiments are possible only with the minimum amount of sample, and therefore, it is being widely used in a medical field, a chemical field, a diagnosis field, and a biological field in which it is difficult to obtain a large amount of sample.

In order to analyze a sample or a reagent using the LOC, however, a drive source for transferring the sample or the reagent by a micro unit is needed.

An example of a conventional drive source for driving the LOC is a micro pump. In this connection, a pump using a piezoelectric element, a pump using an electrical capillary phenomenon, a pump using gas generation and extinguishment due to electrolysis, and a rotary pump for introducing and discharging fluid using a rotor have been proposed.

FIG. 1 is a view illustrating the construction of a conventional micro pump, which is a pump for transferring fluid, such as liquid or gas, using interfacial tension changeable due to potential difference. The micro pump includes a gas chamber 120 having a predetermined volume, a capillary tube 110 having one end connected to the gas chamber 120, a transferring pipe 180 connected to the other end of the capillary tube 110 and having an introduction check valve 190 and a discharge check valve 200 mounted therein for allowing the fluid to be transferred only in one direction, a lump of mercury 130 disposed in the middle part of the capillary tube 110, the lump of mercury 130 having an electrical contact pin 150 mounted therein, an electrolytic solution 140 filled in the capillary tube 110 such that one end of the electrolytic solution 140 is adjacent to the lump of mercury 130 and the other end of the electrolytic solution 140 is adjacent to the fluid which is transferred, the electrolytic solution 140 having an electrode 160 disposed therein, and a power source 170 for applying voltage between the electrical contact pin 150 and the electrode 160.

The micro pump with the above-stated construction is operated as follows. When square-wave voltage or sine-wave voltage from the power source 170 is applied to the electrode 160, the interfacial tension of the lump of mercury 130 is changed by the applied voltage. When the interfacial tension of the lump of mercury 130 is periodically changed by the voltage, the lump of mercury 130 performs a reciprocating movement in the capillary tube 110 according to a cycle of voltage supply.

When the lump of mercury 130 moves toward the gas chamber 120 in the capillary tube 110, the electrolytic solution 140 and fluid positioned at the other end of the capillary tube 110, which is connected to the transfer pipe 180, also move toward the gas chamber 120. As a result, the introduction check valve 190 is opened so as to fill the vacant space, and therefore, external fluid is introduced into the other end of the capillary tube 110.

On the other hand, when the lump of mercury 130 moves away from the gas chamber 120 in the capillary tube 110, i.e., toward the transfer pipe 180, the electrolytic solution 140 also moves toward the transfer pipe 180. As a result, the pressure in the transfer pipe 180 increases, and therefore, the discharge check valve 200 is opened, whereby the fluid is transferred through the discharge check valve 200. These processes are repeatedly performed to continuously transfer the fluid.

However, more than a predetermined pressure must be formed in the capillary tube so as to operate the conventional micro pump, and, when the check valve malfunctions, the interior pressure of capillary tube is excessively increased.

Consequently, when medicinal substances are injected into a human body using the conventional micro pump, the human body may encounter a dangerous situation.

Furthermore, the conventional micro pump is constructed in a structure in which the lump of mercury moves due to the application of external voltage so as to introduce or discharge the fluid. Consequently, it is necessary to include not only the gas but also the lump of mercury and the electrolytic solution in the capillary tube and dispose the electrical contact pin in the lump of mercury, which complicates the structure of the micro pump.

SUMMARY OF THE INVENTION

Therefore, the present invention has been made in view of the above problems, and it is an object of the present invention to provide a valve serving as a relief valve or a stabilizer that has a discharge pipe, having a predetermined resistance pressure, connected to the capillary tube, allows fluid to be introduced or discharged due to the gas pressure when the gas pressure in the capillary tube is lower than the resistance pressure of the discharge pipe, and allows the fluid to be discharged out of the capillary tube through the discharge pipe when the gas pressure in the capillary tube is higher than the resistance pressure of the discharge pipe, thereby controlling the supply of fluid using only the gas pressure without the provision of an additional intervention member and preventing more than a predetermined pressure from being applied to the interior of the transfer pipe, and micro fluid pump having the same.

In accordance with one aspect of the present invention, the above and other objects can be accomplished by the provision of a valve mounted in a micro fluid pump having a capillary tube, to which a gas supply unit and a fluid transfer pipe are connected, for controlling the introduction and the discharge of fluid, wherein the valve includes a discharge pipe filled with liquid such that the discharge pipe has a predetermined resistance pressure and constructed in a structure in which one end of the discharge pipe is connected to the capillary tube such that the discharge pipe communicates with the interior of the capillary tube, and the other end of the discharge pipe is open, thereby allowing gas out of the capillary tube through the discharge pipe when a gas pressure in the capillary tube exceeds the resistance pressure of the discharge pipe.

In accordance with another aspect of the present invention, there is provided a micro fluid pump including a capillary tube, through which fluid flows, a transfer pipe connected to one end of the capillary tube, the transfer pipe having an introduction check valve and a discharge check valve mounted therein, and a gas supply unit for supplying gas to move the fluid in the capillary tube, wherein the micro fluid pump further includes a valve having a discharge pipe filled with liquid such that the discharge pipe has a predetermined resistance pressure and constructed in a structure in which one end of the discharge pipe is connected to the capillary tube such that the discharge pipe communicates with the interior of the capillary tube, and the other end of the discharge pipe is open, thereby allowing gas out of the capillary tube through the discharge pipe when a gas pressure in the capillary tube exceeds the resistance pressure of the discharge pipe.

Preferably, the valve serves as a relief valve for allowing the gas in the capillary tube to be discharged to the outside through the discharge pipe, when the interior pressure of the capillary tube exceeds a predetermined pressure level, thereby controlling the interior pressure of the capillary tube to be an atmospheric pressure. Alternatively, the valve may further include an exhaust part formed at the other end of the discharge pipe, and the valve may serve as a stabilizer for allowing the gas in the capillary tube to pass through the liquid and be exhausted to the outside in an air bubble phase until the interior pressure of the capillary tube is stabilized, when the interior pressure of the capillary tube exceeds a predetermined pressure level, thereby uniformly stabilizing the interior pressure of the capillary tube.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
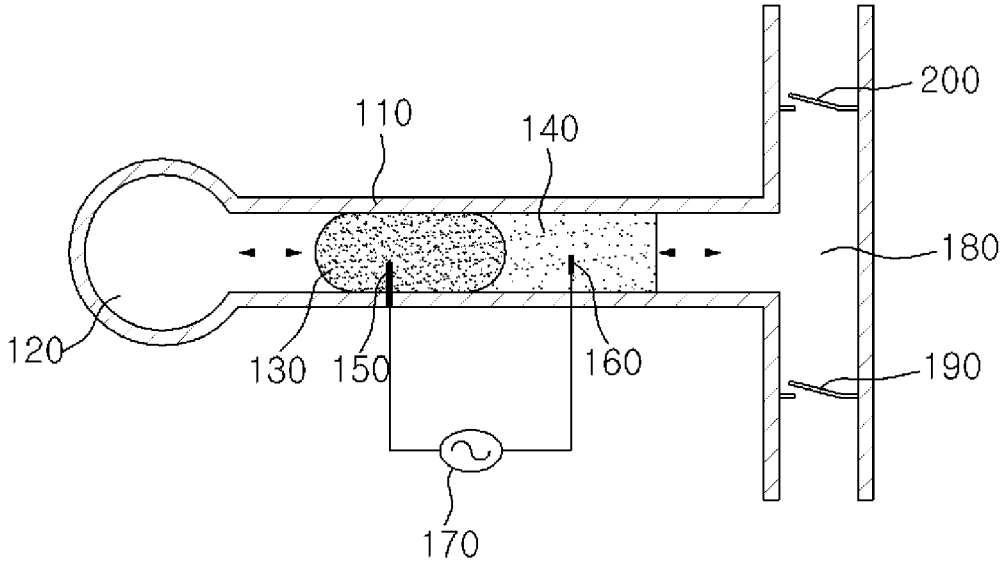
FIG.1 PRIOR ART
FIG. 1 is a view illustrating the construction of a conventional micro pump.
Figure 2:
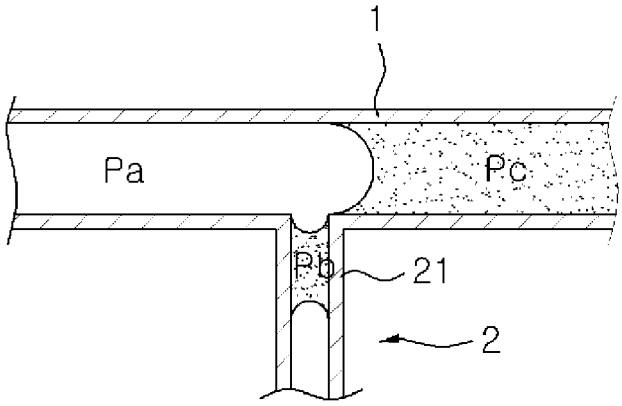
FIG. 2 is a view illustrating the construction of a valve according to a first embodiment of the present invention.

FIG. 2 is a view illustrating the construction of a valve 2 according to a first embodiment of the present invention. The valve 2 is mounted in a micro fluid pump having a capillary tube 1, to which a gas supply unit and a fluid transfer pipe are connected, for controlling the introduction and the discharge of fluid. According to this embodiment, the valve 2 includes a discharge pipe 21 having a predetermined resistance pressure and constructed in a structure in which one end of the discharge pipe 21 is connected to the capillary tube 1 such that the discharge pipe 21 communicates with the interior of the capillary tube 1, and the other end of the discharge pipe 21 is open. Consequently, the valve 2 according to this embodiment serves as a relief valve for allowing gas in the capillary tube 1 to be completely discharged to the outside through the discharge pipe 21 when a gas pressure in the capillary tube 1 exceeds the resistance pressure of the discharge pipe 21.

Figure 3:
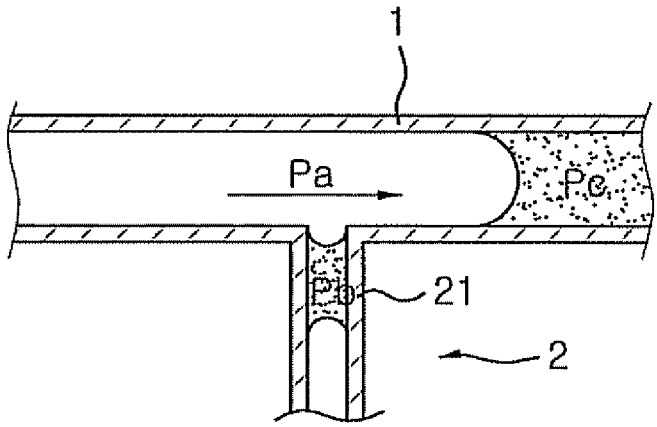
FIGS. 3 and 4 are views illustrating the operation of the valve according to the first embodiment of the present invention.
Figure 4:
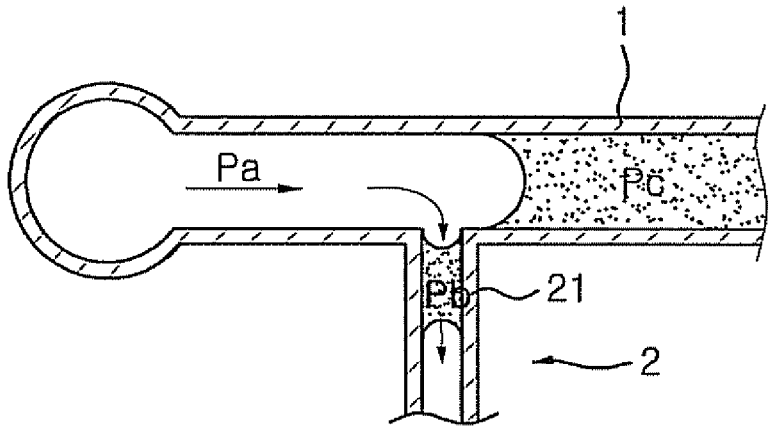

FIGS. 3 and 4 are views illustrating the operation of the valve according to the first embodiment of the present invention. The discharge pipe 21 of the valve 2 has an interior pressure Pb (hereinafter, referred to as "a resistance pressure") formed at the interface between gas and fluid in the discharge pipe 21. As shown in FIG. 3, the gas in the capillary tube 1 pushes out the fluid in the capillary tube 1 with a predetermined pressure. Specifically, when a gas pressure Pa in the capillary tube 1 is lower than the resistance pressure Pb and is higher than a fluid pressure Pc, the gas in the capillary tube 1 continuously pushes out the fluid in the capillary tube 1.

As shown in FIG. 4, on the other hand, when the gas pressure Pa in the capillary tube 1 continues to increase, and therefore, the gas pressure Pa in the capillary tube 1 exceeds the resistance pressure Pb of the discharge pipe 21, the gas does not push out the fluid any longer, and therefore, the gas is completely discharged to the outside through the discharge pipe 21.

As can be seen from the above description, the valve 2 according to the present invention serves as the relief valve that completely discharges the gas out of the capillary tube 1, when the pressure applied to the fluid, i.e., the gas pressure in the capillary tube 1, exceeds a predetermined pressure level, i.e., the resistance pressure of the discharge pipe 21, only through the use of the gas pressure and the resistance pressure of the discharge pipe 21 without the provision of an additional intervention member, thereby preventing excessive pressure from being applied to the fluid.

Figure 5:
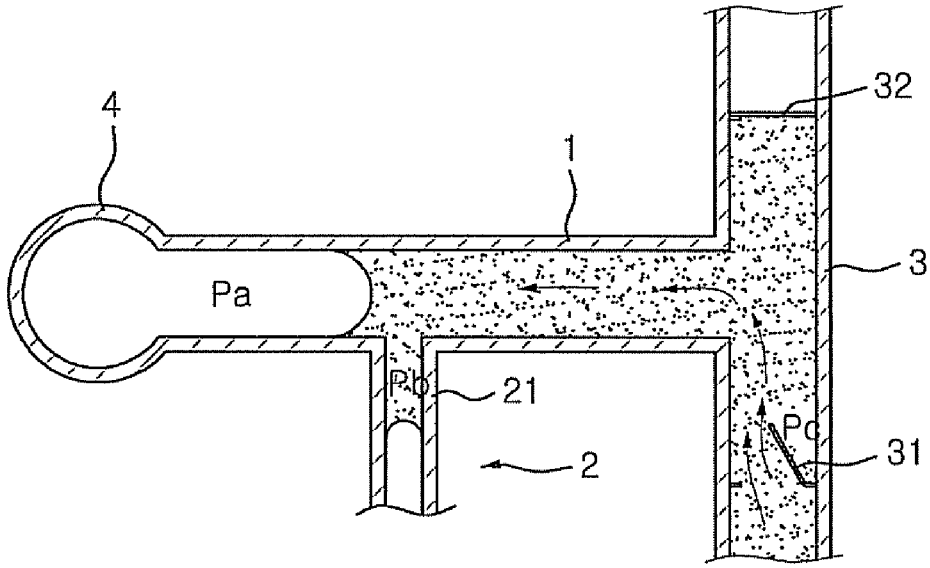
FIGS. 5 to 7 are views illustrating the construction and the operation of a micro fluid pump having the valve according to the first embodiment of the present invention.
Figure 6:
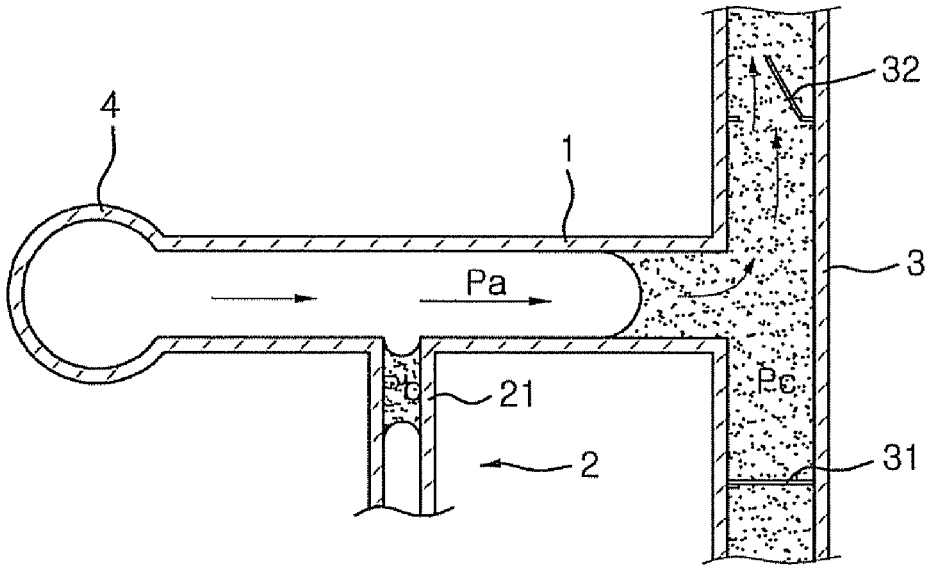
Figure 7:
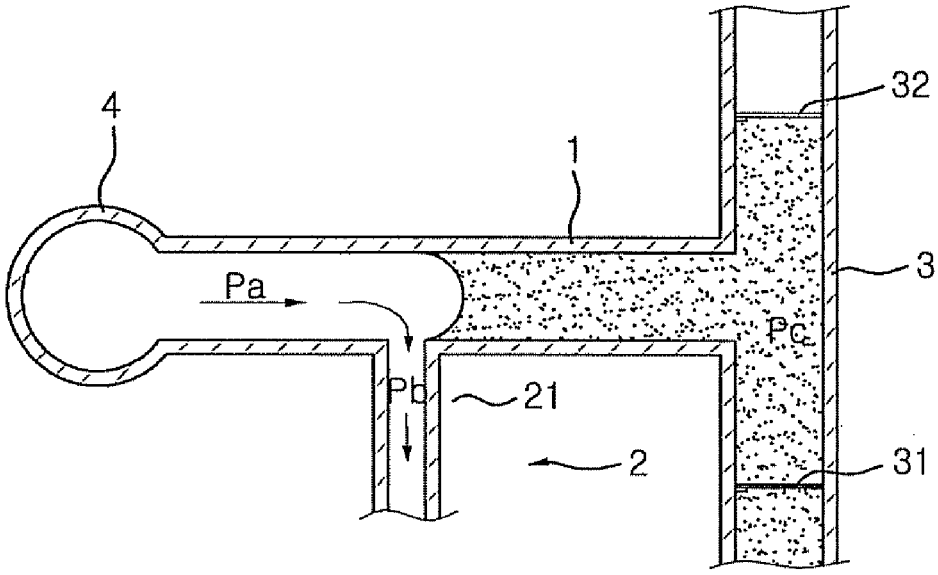

FIGS. 5 to 7 are views illustrating the construction and the operation of a micro fluid pump having the valve according to the first embodiment of the present invention. The micro fluid pump includes a capillary tube 1, through which fluid flows, a transfer pipe 3 connected to one end of the capillary tube 1, the transfer pipe 3 having an introduction check valve 31 and a discharge check valve 32 mounted therein, and a gas supply unit 4 for supplying gas to move the fluid in the capillary tube 1. According to the present invention, the micro fluid pump further includes a valve 2 including a discharge pipe 21 having a predetermined resistance pressure and constructed in a structure in which one end of the discharge pipe 21 is connected to the capillary tube 1 such that the discharge pipe 21 communicates with the interior of the capillary tube 1, thereby serving as a relief valve for allowing gas in the capillary tube 1 to be completely discharged to the outside through the discharge pipe 21 when a gas pressure in the capillary tube 1 exceeds a resistance pressure of the discharge pipe 21.

Hereinafter, the operation of the micro fluid pump having the valve, serving as the relief valve, according to the present invention will be described in detail.

First, as shown in FIG. 5, when there is no supply of gas from the gas supply unit 4, or the gas pressure Pa in the capillary tube 1 is lower than the fluid pressure Pc of the fluid introduced into the transfer pipe 3 and the resistance pressure Pb of the discharge pipe 21, and the fluid pressure Pc is lower than the resistance pressure Pb of the discharge pipe 21, the introduction check valve 31 is opened, and therefore, fluid is introduced into the capillary tube 1.

As shown in FIG. 6, on the other hand, when gas from the gas supply unit 4 is supplied to the capillary tube 1, the gas pressure Pa in the capillary tube 1 exceeds the fluid pressure of the fluid introduced into transfer pipe 3 with the result that the gas in the capillary tube 1 pushes out the fluid in the capillary tube 1. At this time, the introduction check valve 31 is closed, and the discharge check valve 32 is opened. As a result, the fluid is discharged through the discharge check valve 32. Here, the resistance pressure Pb of the discharge pipe 21 is greater than the gas pressure Pa in the capillary tube 1.

When more than a predetermined amount of fluid is supplied as a result of the fluid supply through the discharge check valve 32, or the check valve malfunctions, and therefore, excessive resistance is generated in the transfer pipe 3, the fluid pressure Pc is increased, and, when the gas is continuously supplied, the gas pressure Pa in the capillary tube 1 is also increased due to the increased gas.

When the gas pressure Pa in the capillary tube 1 is increased, and therefore, the gas pressure Pa in the capillary tube 1 exceeds the resistance pressure Pb of the discharge pipe 21, the gas having the increased pressure is discharged out of the capillary tube 1 through the discharge pipe 21, as shown in FIG. 7. As a result, the pressure in the capillary tube 1 is changed into the atmospheric pressure.

The conventional valve has a problem in that, when more than a predetermined amount of fluid is supplied, or the gas pressure is continuously increased while the check valve is out of order, excessive fluid may be continuously supplied, or the micro fluid pump having the conventional valve may malfunction. For example, when medicinal substances are injected into a human body, the human body may encounter a dangerous situation.

On the other hand, the valve, serving as the relief valve, according to the present invention has a predetermined resistance pressure, and discharges the gas to the outside when a pressure greater than the predetermined resistance pressure is applied, thereby eliminating the dangerous factors caused by the conventional valve.

Figure 8:
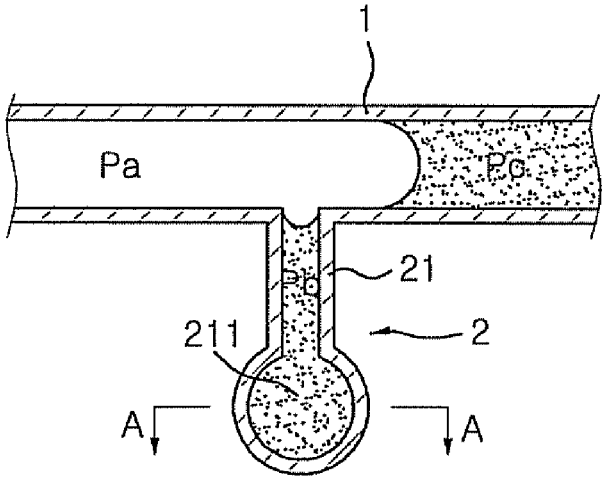
FIG. 8 is a view illustrating the construction of a valve according to a second embodiment of the present invention.
Figure 9:
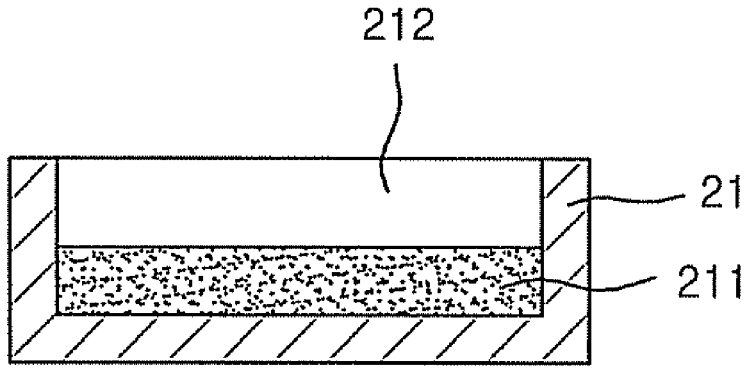
FIG. 9 is a sectional view taken along line A-A' of FIG. 8.

FIG. 8 is a view illustrating the construction of a valve 2 according to a second embodiment of the present invention, and FIG. 9 is a sectional view taken along line A-A' of FIG. 8. The valve 2 is mounted in a micro fluid pump having a capillary tube 1, to which a gas supply unit and a fluid transfer pipe 3 are connected, for controlling the introduction and the discharge of fluid. According to this embodiment, the valve 2 includes a discharge pipe 21 having a predetermined resistance pressure and constructed in a structure in which one end of the discharge pipe 21 is connected to the capillary tube 1 such that discharge pipe 21 communicates with the interior of the capillary tube 1, and an exhaust part 212 is formed at the other end of the discharge pipe 21 for receiving fluid 211. Consequently, the valve 2 according to this embodiment serves as a stabilizer for allowing the gas in the capillary tube 1 to be exhausted through the exhaust part 212 of the discharge pipe 21 in an air bubble phase to stabilize the interior pressure of the capillary tube 1 when a gas pressure in the capillary tube 1 exceeds the resistance pressure of the discharge pipe 21.

Figure 10:
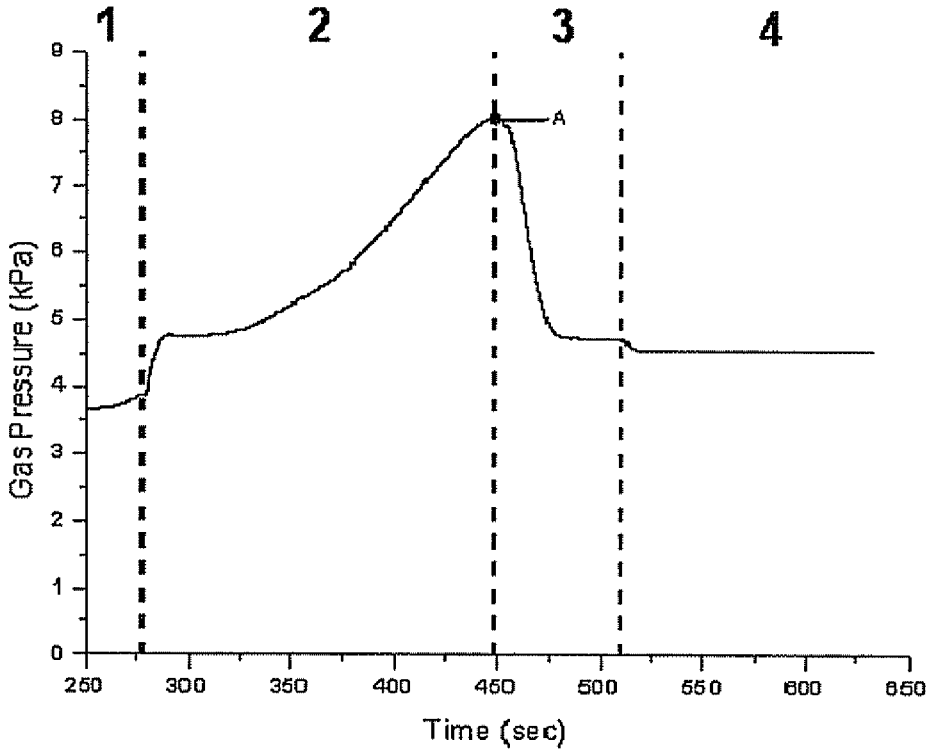
FIG. 10 is a graph illustrating the change of gas pressure depending upon time in a capillary tube to which the valve, serving as a stabilizer, according to the present invention is connected.

FIG. 10 is a graph illustrating the change of gas pressure depending upon time in the capillary tube to which the valve, serving as the stabilizer, according to the present invention is connected. Hereinafter, the operation of the valve according to the second embodiment of the present invention will be described in detail with reference to FIGS. 8 to 10.

First, when the gas pressure Pa in the capillary tube 1 is lower than the resistance pressure Pb of the discharge pipe 21, the fluid is continuously pushed out, and, as a result of the continuous supply of air, the interior pressure of the capillary tube 1 gradually increases with the passage of time. When the gas pressure Pa in the capillary tube 1 gradually increases, and therefore, the gas pressure Pa in the capillary tube 1 reaches an "A" point at which the gas pressure Pa in the capillary tube 1 is higher than the resistance pressure Pb of the discharge pipe 21, the gas is discharged out of the capillary tube 1 through the discharge pipe 21.

When the gas is discharged out of the capillary tube 1 through the discharge pipe 21, the interior pressure of the capillary tube 1 decreases as indicated in Section 3.

After that, a predetermined amount of gas from the capillary tube 1 is guided periodically to the discharge pipe 21. The gas guided to the discharge pipe 21 passes over the liquid 211 in an air bubble phase, and is then discharged to the outside. As a result, the gas pressure Pa in the capillary tube 1 reaches equilibrium as indicated in Section 4 where the gas pressure Pa in the capillary tube 1 is uniformly maintained.

Figure 11:
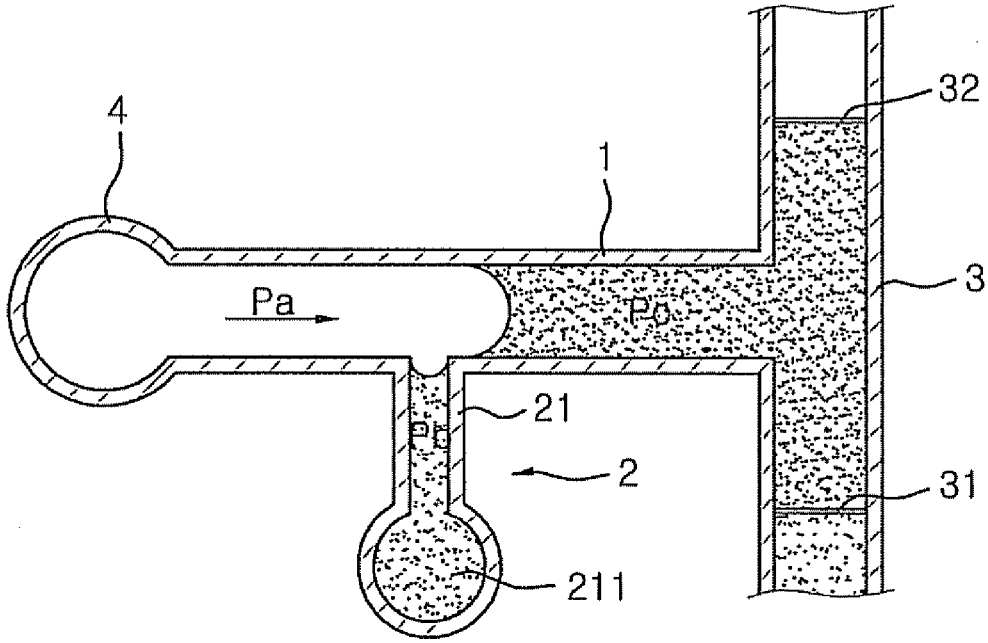
FIG. 11 is a view illustrating the construction and the operation of a micro fluid pump having the valve according to the second embodiment of the present invention.

FIG. 11 is a view illustrating the construction and the operation of a micro fluid pump having the valve according to the second embodiment of the present invention. The micro fluid pump includes a capillary tube 1, through which fluid flows, a transfer pipe 3 connected to one end of the capillary tube 1, the transfer pipe 3 having an introduction check valve 31 and a discharge check valve 32 mounted therein, and a gas supply unit 4 for supplying gas to move the fluid in the capillary tube 1. According to the present invention, the micro fluid pump further includes a valve 2 including a discharge pipe 21 having a predetermined resistance pressure and constructed in a structure in which one end of the discharge pipe 21 is connected to the capillary tube 1 such that discharge pipe 21 communicates with the interior of the capillary tube 1, and an exhaust part 212 is formed at the other end of the discharge pipe 21 for receiving fluid 211, thereby serving as a stabilizer for allowing the gas in the capillary tube 1 to be exhausted through the exhaust part 212 of the discharge pipe 21 in an air bubble phase to stabilize the interior pressure of the capillary tube 1 when a gas pressure in the capillary tube 1 exceeds the resistance pressure of the discharge pipe 21.

Hereinafter, the operation of the micro fluid pump having the valve, serving as the stabilizer, according to the present invention will be described in detail.

First, when there is no supply of gas from the gas supply unit 4, or the gas pressure Pa in the capillary tube 1 is lower than the resistance pressure Pb of the discharge pipe 21 and the fluid pressure Pc of the fluid introduced into the transfer pipe 3, the introduction check valve 31 is opened, and therefore, fluid is introduced into the capillary tube 1.

On the other hand, when gas from the gas supply unit 4 is supplied to the capillary tube 1 at a pressure lower than the resistance pressure Pb of the discharge pipe 21, the gas pressure Pa in the capillary tube 1 exceeds the fluid pressure of the fluid introduced into transfer pipe 3 with the result that the gas in the capillary tube 1 pushes out the fluid in the capillary tube 1. At this time, the introduction check valve 31 is closed, and the discharge check valve 32 is opened. As a result, the fluid is discharged through the discharge check valve 32.

In this way, the supply of fluid is continuously carried out by the supply of gas into the capillary tube 1. When more than a predetermined amount of fluid is supplied, or the check valve malfunctions, excessive resistance is generated in the transfer pipe 3. When the gas is continuously supplied in this state, the gas pressure Pa in the capillary tube 1 is also excessively increased.

Consequently, the gas pressure Pa in the capillary tube 1 exceeds the resistance pressure Pb of the discharge pipe 21.

As a result, the gas in the capillary tube 1 passes through the liquid in the discharge pipe 21, and is then discharged to the outside in an air bubble phase. After a predetermined amount of gas has been discharged to the outside, the interior pressure of the capillary tube 1 is stabilized into an equilibrium phase due to the liquid in the discharge pipe 21.

As can be seen from the above description, the valve 2, serving as the stabilizer, according to the present invention controls the supply of fluid using only the gas pressure and the resistance pressure of the discharge pipe 21 without the provision of an additional intervention member, thereby allowing the gas to be discharged through the discharge pipe 21, such that the gas passes through the liquid in the discharge pipe 21, in an air bubble phase until the interior pressure of the capillary tube 1 is stabilized when the pressure applied to the fluid, i.e., the gas pressure in the capillary tube 1, exceeds a predetermined pressure level, i.e., the resistance pressure of the discharge pipe 21, so as to uniformly maintain, i.e., stabilize, the interior pressure of the capillary tube 1.

As apparent from the above description, the valve according to the present invention serves as a relief valve that has a discharge pipe, having a predetermined resistance pressure, connected to the capillary tube, allows fluid to be introduced or discharged due to the gas pressure when the gas pressure in the capillary tube is lower than the resistance pressure of the discharge pipe, and allows the fluid to be completely discharged out of the capillary tube through the discharge pipe when the gas pressure in the capillary tube is higher than the resistance pressure of the discharge pipe. Also, the valve according to the present invention serves as a stabilizer that has a discharge pipe, having a predetermined resistance pressure, connected to the capillary tube, allows fluid to be introduced or discharged due to the gas pressure when the gas pressure in the capillary tube is lower than the resistance pressure of the discharge pipe, and allows the fluid to be discharged in an air bubble phase until the interior pressure of the capillary tube is stabilized when the gas pressure in the capillary tube is higher than the resistance pressure of the discharge pipe. Consequently, the present invention has the effect of controlling the supply of fluid using only the gas pressure without the provision of an additional intervention member, thereby simplifying the construction of the valve and the micro fluid pump. In addition, the present invention has the effect of preventing more than a predetermined pressure from being applied to the interior of the transfer pipe, thereby eliminating dangerous factors, such as damage and malfunction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A micro fluid pump comprising:

a capillary tube, through which fluid flows;

a transfer pipe connected to one end of the capillary tube, the transfer pipe having an introduction check valve and a discharge check valve mounted therein; and a gas supply unit for supplying gas to move the fluid in the capillary tube, wherein the micro fluid pump further comprises:

a valve including a discharge pipe filled with liquid such that the discharge pipe has a predetermined resistance pressure and constructed in a structure in which one end of the discharge pipe is connected to the capillary tube such that the discharge pipe communicates with the interior of the capillary tube, and the other end of the discharge pipe is open, thereby allowing gas out of the capillary tube through the discharge pipe when a gas pressure in the capillary tube exceeds the resistance pressure of the discharge pipe.

2. The micro fluid pump according to claim 1, wherein the valve serves as a relief valve for allowing the gas in the capillary tube to be discharged to the outside through the discharge pipe, when the interior pressure of the capillary tube exceeds a predetermined pressure level, thereby controlling the interior pressure of the capillary tube to be an atmospheric pressure.

3. The micro fluid pump according to claim 1, wherein the valve further includes an exhaust part formed at the other end of the discharge pipe, and the valve serves as a stabilizer for allowing the gas in the capillary tube to pass through the liquid and be exhausted to the outside in an air bubble phase until the interior pressure of the capillary tube is stabilized, when the interior pressure of the capillary tube exceeds a predetermined pressure level, thereby uniformly stabilizing the interior pressure of the capillary tube.

* * * * *